US005560159A

United States Patent [19]

Pennypacker

[11] Patent Number: 5,560,159

[45] Date of Patent: Oct. 1, 1996

[54] DECORATIVE BEAM ASSEMBLY

[76] Inventor: Mike C. Pennypacker, 15517 Peach Hill Ct. #811, Chesterfield, Mo. 63017

[21] Appl. No.: 369,150

[22] Filed: Jan. 5, 1995

[51] Int. Cl.[6] ..... E04C 3/36; E04F 19/00

[52] U.S. Cl. ..... 52/126.1; 52/311.1; 52/726.2; 52/726.3; 52/730.7; 52/736.1; 52/736.4; 52/738.1; 211/105.4; 211/207; 403/230; 405/288

[58] Field of Search ..... 52/506.06, 726.2, 52/726.3, 730.7, 733.2, 736.1, 736.3, 736.4, 738.1, 311.1, 311.2, 311.3, 126.1, 126.6, DIG. 8; 211/105.3, 105.4, 207, 107, 22; 405/288; 403/230, 264

[56] References Cited

U.S. PATENT DOCUMENTS

| | | | |
|---|---|---|---|
| 776,344 | 11/1904 | Nielson | 52/DIG. 8 X |
| 2,441,330 | 5/1948 | Phillips | 405/288 |
| 2,474,434 | 6/1949 | Mentz | 211/105.4 X |
| 2,964,276 | 12/1960 | Silversthorne | 211/105.4 X |
| 3,014,685 | 12/1961 | Jensen et al. | 211/105.4 X |
| 3,062,157 | 11/1962 | Woods | 403/264 X |
| 3,267,627 | 8/1966 | Hammitt | 52/726.3 X |
| 3,277,624 | 10/1966 | Cornell | 52/506.06 |
| 3,324,613 | 6/1967 | Duboff | 52/726.3 X |
| 3,421,269 | 1/1969 | Medow | 52/311.2 X |
| 4,558,544 | 12/1985 | Albrecht et al. | 52/126.6 |
| 4,718,213 | 1/1988 | Butterfield | 52/313 X |
| 4,841,709 | 6/1989 | Peterson et al. | 52/506.06 X |
| 5,186,430 | 2/1993 | Ellithorpe | 405/288 X |

FOREIGN PATENT DOCUMENTS

| | | | |
|---|---|---|---|
| 217549 | 3/1958 | Australia | 405/288 |
| 2610971 | 8/1988 | France | 52/311.1 |

*Primary Examiner*—Wynn E. Wood
*Assistant Examiner*—Laura A. Saladino

[57] ABSTRACT

An assembly for simulating structural beams within a room. The inventive device includes a beam positionable into an abutting relationship with a ceiling of room so as to extend between opposed walls thereof. Mounting assemblies secure ends of the beam to the walls of the room and include at least one adjustment assembly for sizing the beam to the exact width of the room. The assembly may further include a post positionable between the beam and a floor of the room.

7 Claims, 4 Drawing Sheets

DECORATIVE BEAM ASSEMBLY

BACKGROUND OF THE INVENTION

1. Field of the Invention

The present invention relates to building structures and more particularly pertains to an decorative beam assembly for simulating structural beams within a room.

2. Description of the Prior Art

The use of building structures is known in the prior art. More specifically, building structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art building structures include U.S. Pat. No. 5,001,877; U.S. Pat. No. 4,926,606; U.S. Pat. No. 4,367,616; U.S. Pat. No. 3,817,178; and U.S. Pat. No. 3,733,766.

While these devices fulfill their respective, particular objectives and requirements, the aforementioned patents do not disclose a decorative beam assembly for simulating structural beams within a room which includes a beam positionable into an abutting relationship with a ceiling of the room so as to extend between opposed walls thereof, and mounting assemblies securing ends of the beam to the walls of the room, wherein at least one of the mounting assemblies includes an adjustment assembly for sizing the beam to the exact width of the room.

In these respects, the decorative beam assembly according to the present invention substantially departs from the conventional concepts and designs of the prior art, and in so doing provides an apparatus primarily developed for the purpose of simulating structural beams within a room.

SUMMARY OF THE INVENTION

In view of the foregoing disadvantages inherent in the known types of building structures now present in the prior art, the present invention provides a new decorative beam assembly construction wherein the same can be utilized for simulating structural beams within a room. As such, the general purpose of the present invention, which will be described subsequently in greater detail, is to provide a new decorative beam assembly apparatus and method which has many of the advantages of the building structures mentioned heretofore and many novel features that result in a decorative beam assembly which is not anticipated, rendered obvious, suggested, or even implied by any of the prior art building structures, either alone or in any combination thereof.

To attain this, the present invention generally comprises an assembly for simulating structural beams within a room. The inventive device includes a beam positionable into an abutting relation ship with a ceiling of room so as to extend between opposed walls thereof. Mounting assemblies secure ends of the beam to the walls of the room and include at least one adjustment assembly for sizing the beam to the exact width of the room. The assembly may further include a post positionable between the beam and a floor of the room.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new decorative beam assembly apparatus and method which has many of the advantages of the building structures mentioned heretofore and many novel features that result in a decorative beam assembly which is not anticipated, rendered obvious, suggested, or even implied by any of the prior art building structures, either alone or in any combination thereof.

It is another object of the present invention to provide a new decorative beam assembly which may be easily and efficiently manufactured and marketed.

It is a further object of the present invention to provide a new decorative beam assembly which is of a durable and reliable construction.

An even further object of the present invention is to provide a new decorative beam assembly which is susceptible of a low cost of manufacture with regard to both materials and labor, and which accordingly is then susceptible of low prices of sale to the consuming public, thereby making such decorative beam assemblies economically available to the buying public.

Still yet another object of the present invention is to provide a new decorative beam assembly which provides in the apparatuses and methods of the prior art some of the advantages thereof, while simultaneously overcoming some of the disadvantages normally associated therewith.

Still another object of the present invention is to provide a new decorative beam assembly for simulating structural beams within a room.

Yet another object of the present invention is to provide a new decorative beam assembly which includes a beam positionable into an abutting relationship with a ceiling of the room so as to extend between opposed walls thereof, and mounting assemblies securing ends of the beam to the walls of the room, wherein at least one of the mounting assemblies includes an adjustment assembly for sizing the beam to the exact width of the room.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
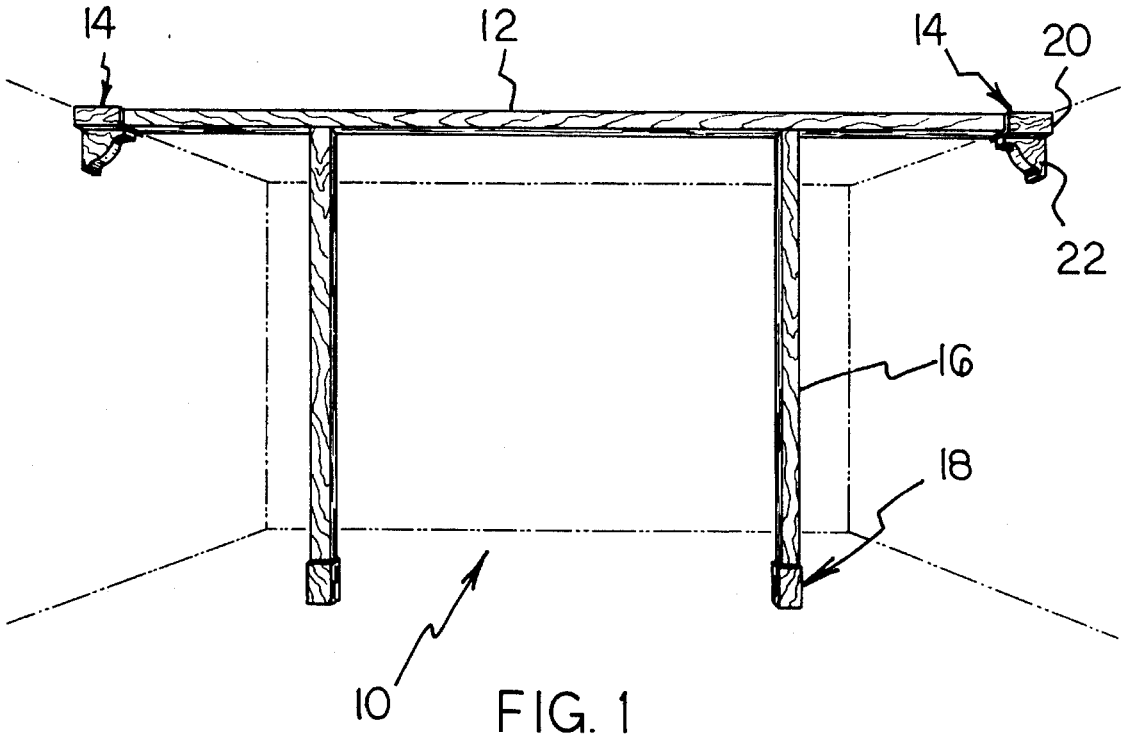
FIG. 1 is an isometric illustration of a decorative beam assembly according to the present invention in use.

With reference now to the drawings, and in particular to FIGS. 1–8 thereof, a new decorative beam assembly embodying the principles and concepts of the present invention and generally designated by the reference numeral 10 will be described.

More specifically, it will be noted that the decorative beam assembly 10 comprises a beam 12 positionable against an unlabeled ceiling of a room so as to extend between opposed walls thereof substantially as shown in FIG. 1. Beam mounting means 14 are secured to opposed ends of the beam 12 and operate to engage the opposed walls of the room so as to support the beam 12 into abutting contact with the ceiling of the room. The present invention 10 may additionally comprise posts 16 positionable between the beam 12 and a floor of the room, with a post mounting means 18 facilitating securement of a lower end of the post relative to the floor of the room.

Figure 2:
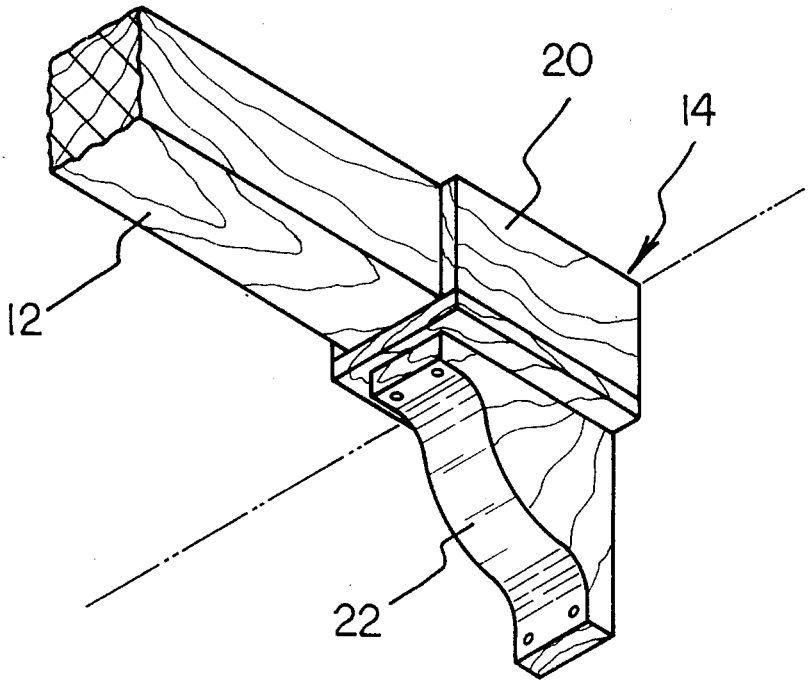
FIG. 2 isometric illustration of a mounting means comprising a portion of the present invention.

As shown in FIG. 2, the beam mounting means 14 includes a three-sided sleeve 20 positionable over a portion of the beam 12 so as to disguise further structure of the mounting means 14 which will be subsequently described in more detail. If desired, a strut 22 can be secured to the three-sided sleeve 20 and to an adjacent wall surface to provide further support for the beam 12 and to increase aesthetic appearance of the assembly 10.

Figure 3:
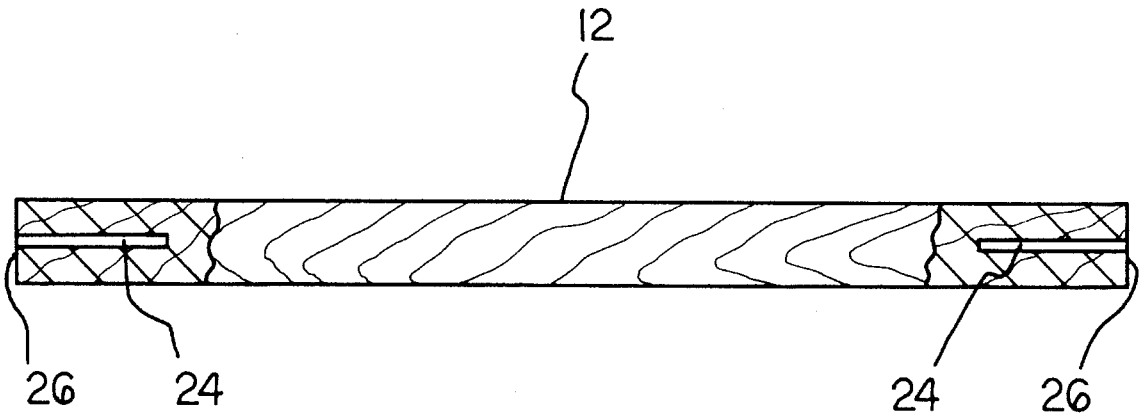
FIG. 3 is a side elevation view, partially in cross section of a beam of the invention.

As shown in FIG. 3, the beam 12 is preferably an elongated wooden beam of any desired cross section. Preferably, the beam 12 is shaped so as to have a square or rectangular cross section and can be stained or finished as desired. The beam 12 includes at least one bore 24 directed into at least one of the opposed ends 26 of the beam 12. The bore 24 operates to receive a portion of the mounting means 14 in a manner which will subsequently be described in more detail.

Figure 4:
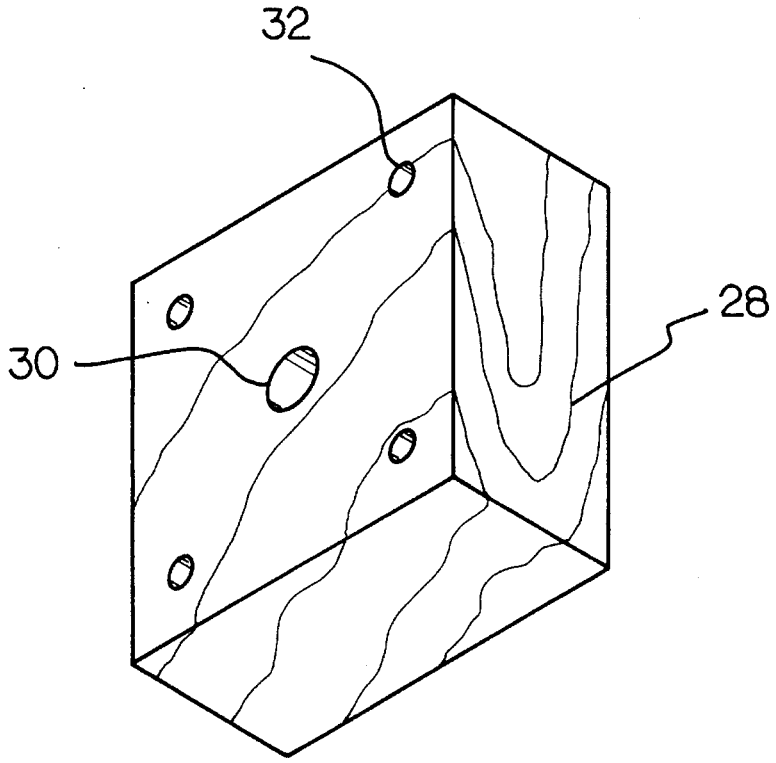
FIG. 4 is an isometric illustration of a mounting block comprising a potion of the mounting means.
Figure 7:
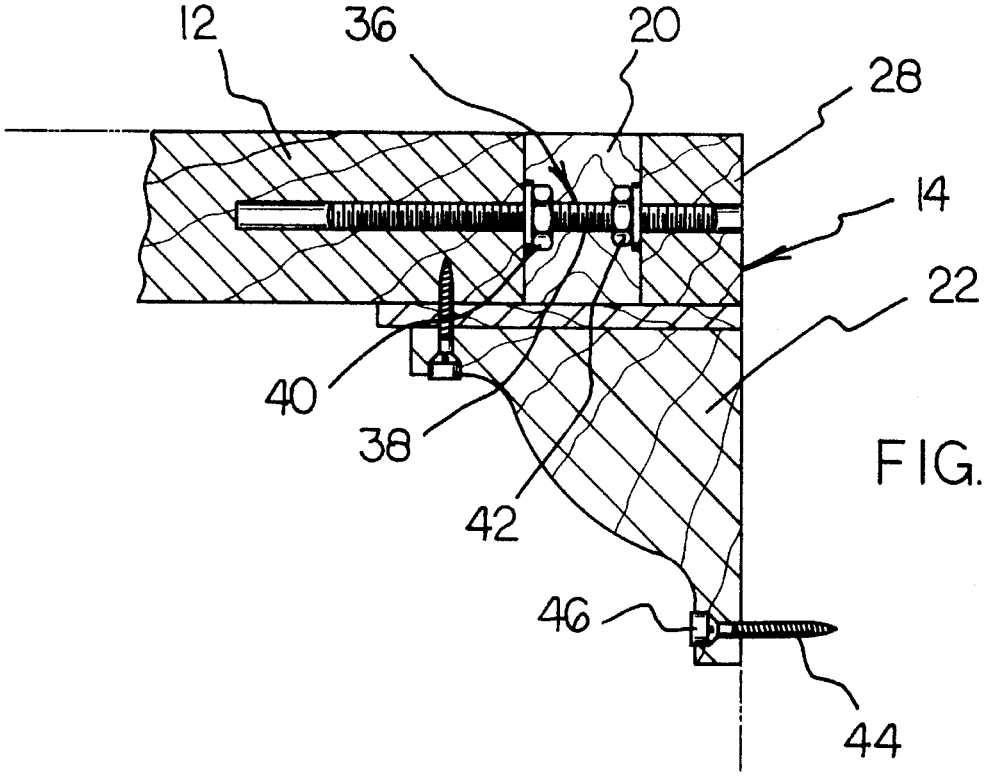
FIG. 7 is a cross sectional view of the beam mounting means of the invention including a strut.
Figure 8:
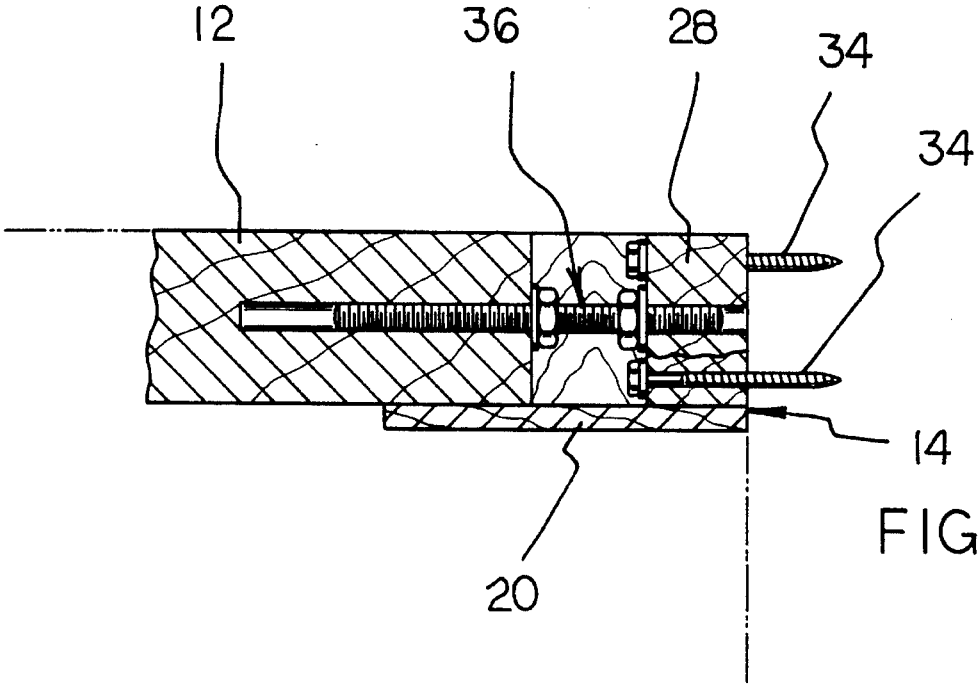
FIG. 8 is a cross sectional view of the beam mounting means excluding the strut.

Referring now to FIGS. 7 and 8, wherein the mounting means 14 is illustrated in detail, it can be shown that the beam mounting means 14 according to the present invention 10 preferably comprises a mounting block 28 positionable into abutting contact with a wall surface of the room to which the device 10 is to be associated with. The mounting block 28, as shown in FIG. 4, includes a bore 30 directed thereinto. The mounting block 28 may additionally include a plurality of mounting apertures 32 directed therethrough which permit fastening of the mounting block 28 securely to the wall surface by a plurality of mounting block foot fasteners 34 directed therethrough.

Figure 5:
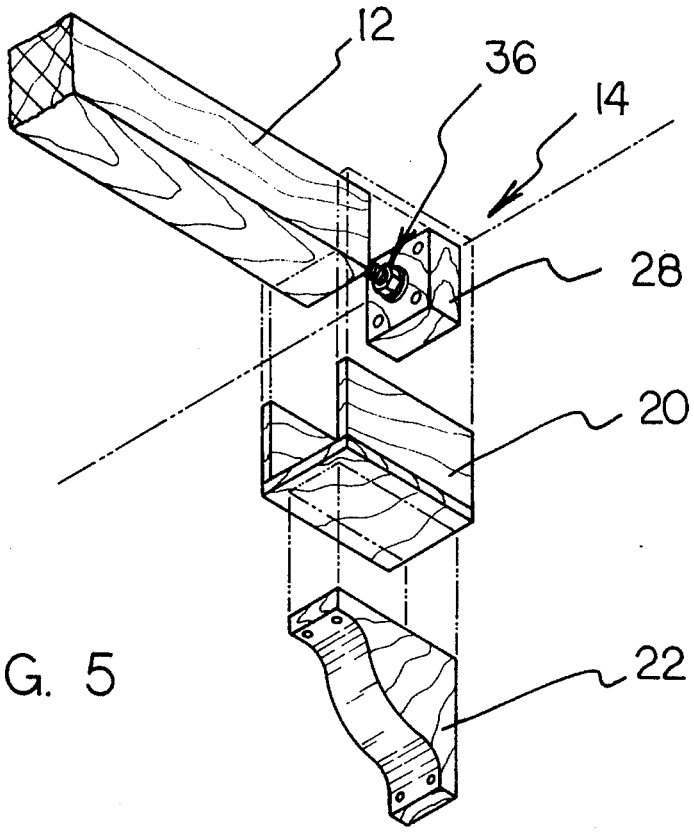
FIG. 5 is an exploded isometric illustration of the mounting means.

With continuing reference to FIGS. 7 and 8, it can be shown that the beam mounting means 14 further comprises an adjustment assembly 36 received within the bore 24 of the beam 12 and within the bore 30 of the mounting block 28 for adjustably positioning the mounting block 28 relative to the beam 12. To this end, the adjustment assembly 36 according to the present invention 10 preferably comprises a threaded rod 38 positioned within the bore 24 of the beam 12 and the bore 30 of the mounting block 28. First and second securing nuts 40 and 42 are threadably engaged to the threaded rod and can be advanced in opposite directions to facilitate spacing of the mounting block 28 from the beam 12. By this structure, the mounting block 28 can be positioned into abutting engagement with the wall surface, whereby a tightening or expanding of the adjustment assembly 36 will effect securement of the beam 12 relative to the ceiling and wall of the room. The mounting block 28 may simply frictionally engage the wall surface, or alternatively may be fixedly secured thereto through a use of the mounting block threaded fasteners 34 as described above. As shown in FIG. 5, the three-sided sleeve 20 extends over the mounting block and the adjustment assembly 36 so as to conceal the same from view. The strut 22 can also be secured beneath the three-sided sleeve 20 by strut threaded fasteners 44 directed therethrough which engage either the beam 12, the three-sided sleeve 20 or the wall as desired to secure the strut 22 relative to the device 10. Further, a plurality of plugs 46 are provided for concealment of heads of the strut threaded fasteners 44 as shown in FIG. 7.

The beam 12 can be secured at both ends by the beam mounting means 14, or alternatively, a single end of the beam 12 can be positioned into engagement with a first wall of the room and supported relative thereto by a first one of the struts 22. The second end of the beam 12 can be provided with the beam mounting means 14 including the adjustment assembly 36 for adjustably sizing the beam 12 to the exact width of the room. Alternatively, both ends 26 of the beam 12 can include the adjustment assemblies 36 if so desired.

As shown in Figure 1, the posts 16 can be positioned between the beam 12 and a floor of the room. However, it is with the intent and purview of the present invention to position the post 16 into abutting engagement with a ceiling of the room and the floor absent a beam 12 extending thereacross. Further, a plurality of beams 12 can be extended across the room with additional beams extending substantially orthogonally between adjacent beams. Thus, any number of beams 12 or posts 16 can be utilized to decorate a room as desired.

Figure 6:
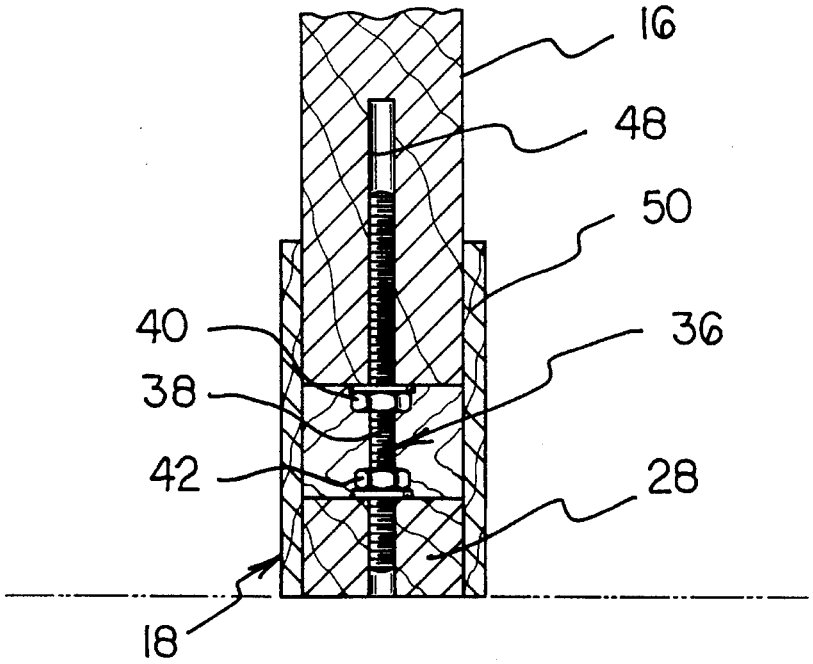
FIG. 6 is a cross sectional view of a post mounting means of the present invention.

The posts 16 extend downward from the beam 12 and engage the floor via a post mounting means 18. As shown in FIG. 6, the post mounting means 18 according to the present invention 10 comprises a bore 48 directed into the post 16 which receives an adjustment assembly 36 of similar design to the adjustment assemblies 36 of the beam mounting means 14. A mounting block 28 engages the floor of the room, whereby an adjustment of the adjustment assembly 36 will effect spacing of the post 16 from the mounting block 28 to frictionally secure the post 16 between the beam 12 or ceiling of the room and a floor of the room. If desired, the mounting block 28 can be secured to a floor of the room through a direction of threaded fasteners through the mounting block and into the floor. Lastly, the post mounting means 18 includes a four-sided sleeve 50 which can be slidably positioned over the mounting block 28 and adjustment assembly 36 so as to conceal the same from view.

In use, the decorative beam assembly 10 can be easily installed within a room of an apartment or other dwelling without substantial modification to the walls and/or ceiling of the room. A plurality of beams 12 can be utilized in construction of the device 10 with posts 16 also being utilized if so desired. The present invention serves to decorate an interior of the room so as to simulate structural beams found within certain styles of housing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A decorative beam assembly comprising:

a beam positionable against a ceiling of a room so as to extend between opposed walls of the room;

the beam includes opposed ends, the beam is shaped so as to define a bore directed into at least one of the opposed ends of the beam;

a mounting block positionable into abutting contact with a wall surface of the room, the mounting block including a bore directed thereinto;

an adjustment assembly means received within the bore of the beam and within the bore of the mounting block for adjustably positioning the mounting block relative to the beam;

the adjustment assembly means comprising a threaded rod positioned within the bore of the beam and extending into the bore of the mounting block;

first and second securing nuts threadably engaged to the threaded rod which can be selectively advanced in opposite directions to facilitate spacing of the mounting block from the beam;

the adjustment assembly means can be operated to force the mounting block and one of the opposed ends of the beam into the opposed walls of the room to secure the beam relative to the room;

a beam mounting means for engaging walls of the room to secure opposed ends of the beam therebetween comprising a three-sided sleeve positioned over the mounting block, the adjustment assembly means, and a portion of the beam;

a strut means for securing to the three-sided sleeve and to an adjacent wall surface for supporting the portion of the beam relative to the wall surface.

2. The decorative beam assembly of claim 11, wherein strut means further comprises a strut secured beneath the three-sided sleeve and securable to the adjacent wall surface of the room.

3. The decorative beam assembly of claim 2, wherein the mounting block includes a plurality of mounting apertures directed therethrough.

4. The decorative beam assembly of claim 3, and further comprising a post positionable between the beam and a floor of the room; and a post mounting means for securing a lower end of the post relative to the floor of the room.

5. The decorative beam assembly of claim 4, wherein the post mounting means comprises a post mounting block; and a post adjustment assembly means secured to an end of the post for adjustably positioning the post mounting block relative to the post, wherein the post adjustment assembly means can be operated to force the post mounting block into the floor of the room to secure the post between the floor and a ceiling of the room.

6. The decorative beam assembly of claim 5, wherein the post mounting means further comprises a four-sided sleeve slidably positioned over the post mounting block and the post adjustment assembly means.

7. The decorative beam assembly of claim 6, wherein the post includes a bore directed into an end of the post, and the post mounting block includes a bore directed thereinto, and further wherein the post adjustment assembly means comprises a post threaded rod positioned within the bore of the post and extending into the bore of the post mounting block; and first and second post securing nuts threadably engaged to the post threaded rod which can be selectively advanced in opposite directions to facilitate spacing of the post mounting block from the post.

* * * * *